US006846184B2

(12) United States Patent
Fan et al.

(10) Patent No.: US 6,846,184 B2
(45) Date of Patent: Jan. 25, 2005

(54) LOW INDUCTANCE ELECTRICAL CONTACTS AND LGA CONNECTOR SYSTEM

(75) Inventors: Zhineng Fan, Sunnyvale, CA (US); Che-Yu Li, Ithica, NY (US)

(73) Assignee: High Connection Density Inc., Sunnyvale, CA (US)

( * ) Notice: Subject to any disclaimer, the term of this patent is extended or adjusted under 35 U.S.C. 154(b) by 73 days.

(21) Appl. No.: 10/350,600

(22) Filed: Jan. 24, 2003

(65) Prior Publication Data

US 2004/0147140 A1 Jul. 29, 2004

(51) Int. Cl.[7] ..... H01R 12/00

(52) U.S. Cl. ..... 439/66; 439/886; 439/700; 439/824

(58) Field of Search ..... 439/66, 886, 591, 439/91, 700, 824; 267/166; 324/754

(56) References Cited

U.S. PATENT DOCUMENTS

| | | | |
|---|---|---|---|
| 2,153,177 | A | 4/1939 | Ecker |
| 3,317,885 | A | 5/1967 | Yost |
| 3,513,434 | A | 5/1970 | Zieike |
| 3,795,884 | A | 3/1974 | Kotaka |
| 3,934,959 | A | 1/1976 | Gilissen |
| 4,029,375 | A | 6/1977 | Gabrielian |
| 4,203,203 | A | 5/1980 | Gilissen et al. |
| 4,508,405 | A | 4/1985 | Damon et al. |
| 4,620,761 | A | 11/1986 | Smith et al. |
| 4,707,657 | A | 11/1987 | Boegh-Petersen |
| 4,810,213 | A | 3/1989 | Chabot |
| 4,820,376 | A | 4/1989 | Lambert et al. |
| 4,838,815 | A | 6/1989 | Tajima et al. |
| 4,922,376 | A | 5/1990 | Pommer et al. |
| 4,961,709 | A | 10/1990 | Noschese |
| 5,007,842 | A | 4/1991 | Deak et al. |
| 5,030,109 | A | 7/1991 | Dery |
| 5,035,628 | A | 7/1991 | Casciotti et al. |
| 5,061,191 | A | 10/1991 | Casciotti et al. |
| 5,139,427 | A | 8/1992 | Boyd et al. |
| RE34,084 | E | 9/1992 | Noschese |
| 5,167,512 | A | 12/1992 | Walkup |
| 5,174,763 | A | 12/1992 | Wilson |
| 5,184,962 | A | 2/1993 | Noschese |
| 5,192,213 | A | 3/1993 | Kosugi et al. |
| 5,207,585 | A | 5/1993 | Byrnes et al. |
| 5,211,566 | A | 5/1993 | Bates et al. |
| 5,213,513 | A | 5/1993 | Brown et al. |
| 5,214,563 | A | 5/1993 | Estes |
| 5,232,372 | A | 8/1993 | Bradley et al. |
| 5,237,743 | A | 8/1993 | Busacco et al. |
| 5,248,262 | A | 9/1993 | Busacco et al. |
| 5,273,438 | A | 12/1993 | Bradley et al. |
| 5,299,939 | A | 4/1994 | Walker et al. |
| 5,334,029 | A | 8/1994 | Akkapeddi et al. |
| 5,362,241 | A | 11/1994 | Matsuoka et al. |
| 5,366,380 | A | 11/1994 | Reymond |
| 5,388,997 | A | 2/1995 | Grange et al. |
| 5,388,998 | A | 2/1995 | Grange et al. |

(List continued on next page.)

*Primary Examiner*—P. Austin Bradley
*Assistant Examiner*—Felix O. Figueroa
(74) *Attorney, Agent, or Firm*—Duane Morris LLP

(57) ABSTRACT

An electrical contact having transmission-coil sections with at least two tightly wound turns. Active-coil sections are integral with, and positioned between the transmission-coil sections so as to provide electrical signal communication between the two transmission-coil sections, and spring characteristics. The transmission-coil sections are over coated with a conductive noble metal so as to fuse each of the tightly wound turns together to thereby provide for a shortened electrical transmission pathway through the electrical contact. An LGA interposer for providing data communication between a first and a second array of contact pads is also provided having a dielectric housing with an array of cavities; and a plurality of electrical contacts positioned within the cavities.

18 Claims, 17 Drawing Sheets

U.S. PATENT DOCUMENTS 5,428,191 A 6/1995 Chandler et al.
5,462,440 A 10/1995 Rothenberger
5,473,510 A 12/1995 Dozier, II
5,519,201 A 5/1996 Templeton, Jr. et al.
5,540,593 A 7/1996 Takahashi
5,663,654 A 9/1997 Wood et al.
5,718,040 A 2/1998 Faure et al.
5,727,954 A 3/1998 Kato et al.
5,772,451 A 6/1998 Dozier, II et al.
5,791,914 A 8/1998 Loranger et al.
5,806,181 A 9/1998 Khandros et al.
5,919,050 A 7/1999 Kehley et al.
5,967,798 A 10/1999 Tustaniqskyj et al.
6,032,356 A 3/2000 Eldridge et al.
6,033,233 A 3/2000 Haseyama et al.
6,042,388 A 3/2000 Tustaniwskyj et al.
6,074,219 A 6/2000 Tustaniwskyj et al.
6,079,987 A 6/2000 Matsunaga et al.
6,174,172 B1 * 1/2001 Kazama ..... 439/66
6,174,174 B1 1/2001 Suzuki et al.
6,183,267 B1 2/2001 Marcus et al.
6,183,269 B1 2/2001 Sarkissian et al.
6,224,392 B1 5/2001 Fasano et al.
6,264,476 B1 7/2001 Li et al.
6,299,457 B1 10/2001 Snyder
6,299,460 B1 10/2001 Haselby et al.
6,302,702 B1 10/2001 Audet et al.
6,313,523 B1 11/2001 Morris et al.
6,338,629 B1 1/2002 Fisher et al.
6,375,473 B1 4/2002 Schliebe
6,416,330 B1 7/2002 Yatskov et al.
6,439,894 B1 8/2002 Li
6,439,897 B1 8/2002 Ikeya
6,464,511 B1 10/2002 Watanabe et al.
6,471,524 B1 10/2002 Nakano et al.
6,477,058 B1 11/2002 Luebs et al.
6,559,665 B1 * 5/2003 Barabi ..... 439/66
2003/0006787 A1 * 1/2003 Kazama ..... 324/754
2003/0016037 A1 * 1/2003 Kazama ..... 324/754
2003/0176113 A1 * 9/2003 Sasaki ..... 439/700

* cited by examiner

LOW INDUCTANCE ELECTRICAL CONTACTS AND LGA CONNECTOR SYSTEM

FIELD OF THE INVENTION

The present invention generally relates to interconnection devices used in high speed electronics systems, and more particularly to a high data rate electrical contact adapted for use in connector systems subject to high speed data transmission.

BACKGROUND OF THE INVENTION

High density integrated circuit (IC) packages that house Large Scale Integration/Very Large Scale Integration type semiconductor devices are well known. Input/output pins for such IC packages are often arranged in such a dense pattern (sometimes more than two hundred closely spaced contacts) that direct soldering of the IC package to a substrate; such as a printed wiring or circuit board (PCB) creates several significant problems related to inspection and correction of any resulting soldering faults.

Land grid array (LGA) connectors are known for interconnecting IC packages to PCB's. LGA's typically do not require soldering procedures during engagement with the PCB. Prior art LGA assemblies are also known which include an insulative housing and a plurality of resilient electrical contacts received in passageways formed in the housing. The resilient electrical contacts typically have exposed portions at the upper and lower surfaces of the insulative housing for engaging contact pads. When an IC package is accurately positioned in overlying aligned engagement with the conductive input/output contacts of a typical IC package, a normal force is applied to the exposed portions of each resilient electrical contact to electrically and mechanically engage the respective contact pads.

The resilient electrical contacts associated with prior art LGA's have had a variety of shapes and electrical properties. A commonly used form of resilient electrical contact includes two free ends connected by a curved portion which provides for the storage of elastic energy during engagement with the IC package and PCB. Prior art resilient electrical contacts are usually a single metal structure in the form of a spring to provide the required elastic response during service while also serving as a conductive element for electrical connection. They often also include a metallic shield for enhanced electrical properties. Typically, a combination of barrier metal and noble metal platings are applied to the surface of the spring for corrosion prevention and for electrical contact enhancement. It is often the case that these platings are not of sufficient thickness for electrical conduction along the surface of the spring.

Examples of such prior art resilient conductive contacts may be found in U.S. Pat. Nos.: 6,477,058; 6,471,524; 6,464,511; 6,439,897; 6,439,894; 6,416,330; 6,375,473: 6,338,629; 6,313,523; 6,302,702: 6,299,460; 6,299,457; 6,264,476; 6,224,392; 6,183,269; 6,183,267; 6,174,174; 6,174,172; 6,079,987; 6,074,219; 6,042,388; 6,033,233; 6,032,356; 5,967,798; 5,919,050; 5,806,181; 5,791,914; 5,772,451; 5,727,954; 5,718,040; 5,663,654; 5,540,593; 5,519,201; 5,473,510; 5,462,440; 5,428,191; 5,388,998; 5,388,997; 5,366,380; 5,362,241; 5,334,029; 5,299,939; 5,273,438; 5,248,262; 5,237,743; 5,232,372; 5,214,563; 5,213,513; 5,211,566; 5,207,585; 5,192,213; 5,184,962; 5,174,763;5,167,512; RE34,084; 5,139,427; 5,061,191; 5,035,628; 5,030,109; 5,007,842; 4,961,709; 4,922,376; 4,838,815; 4,820,376; 4,810,213; 4,707,657; 4,620,761; 4,508,405; 4,203,203; 4,029,375; 3,934,959; 3,795,884; 3,513,434; 3,317,885; 2,153,177, which patents are hereby incorporated herein by reference.

A problem in the art exists in that a good material for the construction of a spring, such as a high strength steel, is not a very good electrical conductor. On the other hand, a good electrical conductor, such as a copper alloy or precious metal, is often not a good spring material. In addition, the need for sufficient contact forces to be provided by the spring very often dictates its shape and size. The optimization of these parameters very often results in less than optimal electrical performance.

In particular, the characteristic impedance of the electrical contact is often moved toward undesirable levels as a result of the physical design of the spring, necessitating the use of a shielding material. It is desirable to have a controlled characteristic impedance of the signal from the IC to the printed circuit board without discontinuity, since the close proximity of the electrical contacts often results in cross-talk at a higher data rates. This cross-talk problem may also be alleviated by connecting alternate contacts to ground so as to provide an electrical reference, but at the expense of achievable interconnection density. It is therefore desirable to provide a connector assembly between the IC and a PCB which has a controlled impedance, exhibits wave guide properties with low electrical resistance, provides a short electrical length with high density, and is reliable.

There is a need for a more simplified resilient conductive contact which incorporates the seemingly opposing requirements of good spring properties, high conductivity, and enhanced signal transmission performance. Therefore, an improved electrical contact for use in an LGA socket or electrical connector is needed which can overcome the drawbacks of conventional electrical contacts.

SUMMARY OF THE INVENTION

The present invention provides a low inductance electrical contact comprising at least two transmission-coil sections each comprising at least two tightly wound turns. One or more active-coil sections are integral with, and positioned between the transmission-coil sections so as to provide (i) electrical signal communication between the at least two transmission-coil sections, and (ii) resilient spring characteristics. Advantageously, transmission-coil sections are over coated with a conductive noble metal, e.g., electrodeposited copper or the like, so as to fuse each of the at least two tightly wound turns together and thereby provide for a shortened electrical transmission pathway through the electrical contact.

In an alternative embodiment, a low inductance electrical contact is provided including at least two active-coil sections that electrically communicate with one another through a transmission-coil section. The transmission-coil section comprises at least two tightly wound turns that are over coated with a conductive noble metal so as to fuse the two tightly wound turns together.

An LGA interposer for providing data communication between a first and a second array of contact pads, e.g., as may be arranged on an IC package and test circuit board, comprises a dielectric housing having an array of cavities; and a plurality of low inductance electrical contacts positioned within the cavities. A portion of each electrical contact is electrically accessible to the first and second arrays of contact pads. In one embodiment, each electrical contact includes at least two transmission-coil sections each comprising at least two tightly wound turns. One or more active-coil sections are integral with, and positioned between the transmission-coil sections so as to provide (i) electrical signal communication between the at least two transmission-coil sections, and (ii) spring characteristics. The transmission-coil sections are over coated with a conductive noble metal, e.g., electrodeposited copper or the like, so as to fuse each of the at least two tightly wound turns together and thereby provide for a shortened electrical transmission pathway through the electrical contact. In an alternative embodiment, each electrical contact includes at least two active-coil sections that electrically communicate with one another through a transmission-coil section. The transmission-coil section comprises at least two tightly wound turns that are over coated with a conductive noble metal so as to fuse the two tightly wound turns together.

BRIEF DESCRIPTION OF THE DRAWINGS

These and other features and advantages of the present invention will be more fully disclosed in, or rendered obvious by, the following detailed description of the preferred embodiments of the invention, which are to be considered together with the accompanying drawings wherein like numbers refer to like parts and further wherein.

DETAILED DESCRIPTION OF THE PREFERRED EMBODIMENT

Figure 1:
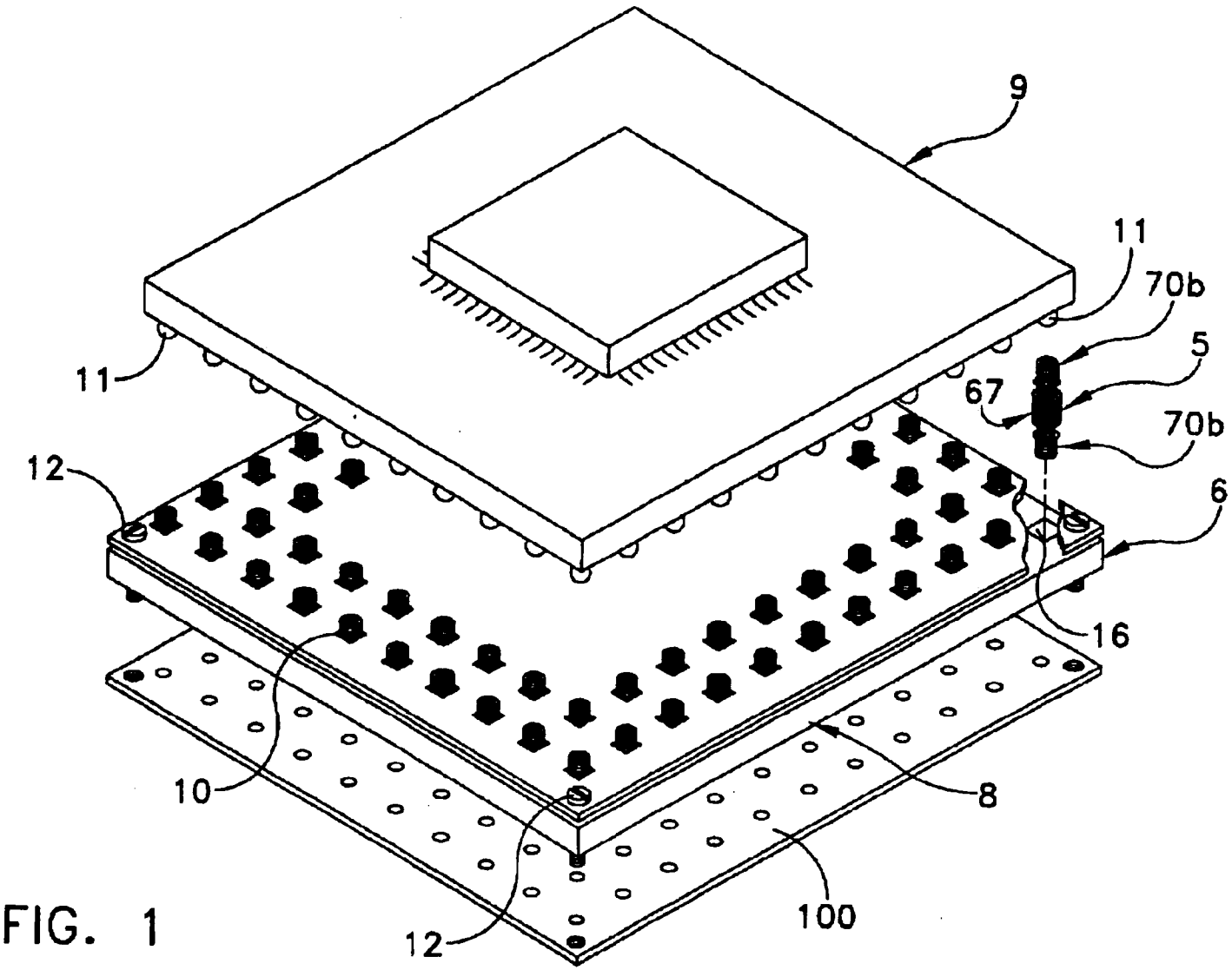
FIG. 1 is an exploded perspective view of an IC package, an interposer, and a circuit board according to the present invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses are intended to cover the structures described, suggested, or rendered obvious by the written description or drawings for performing the recited function, including not only structural equivalents but also equivalent structures.

Referring to FIG. 1, a connector system formed in accordance with the present invention comprises a plurality of low inductance electrical contacts 5 assembled within a housing 6 to form an LGA interposer 8 that is used to interconnect integrated circuit (IC) package 9 to a printed circuit or printed wiring board 100. Housing 6 of LGA interposer 8 includes a plurality of apertures 10 arranged in a grid or array that corresponds to a plurality of input/output contact pads or traces 11 arranged on IC package 9. The portions of housing 6 that define apertures 10 are each sized and shaped so as to accept and support a single electrical contact 5. Means for securely mounting LGA interposer 8 to printed wiring board 100 and to IC package 9 are known to those skilled in the art, e.g., screws 12.

Figure 2:
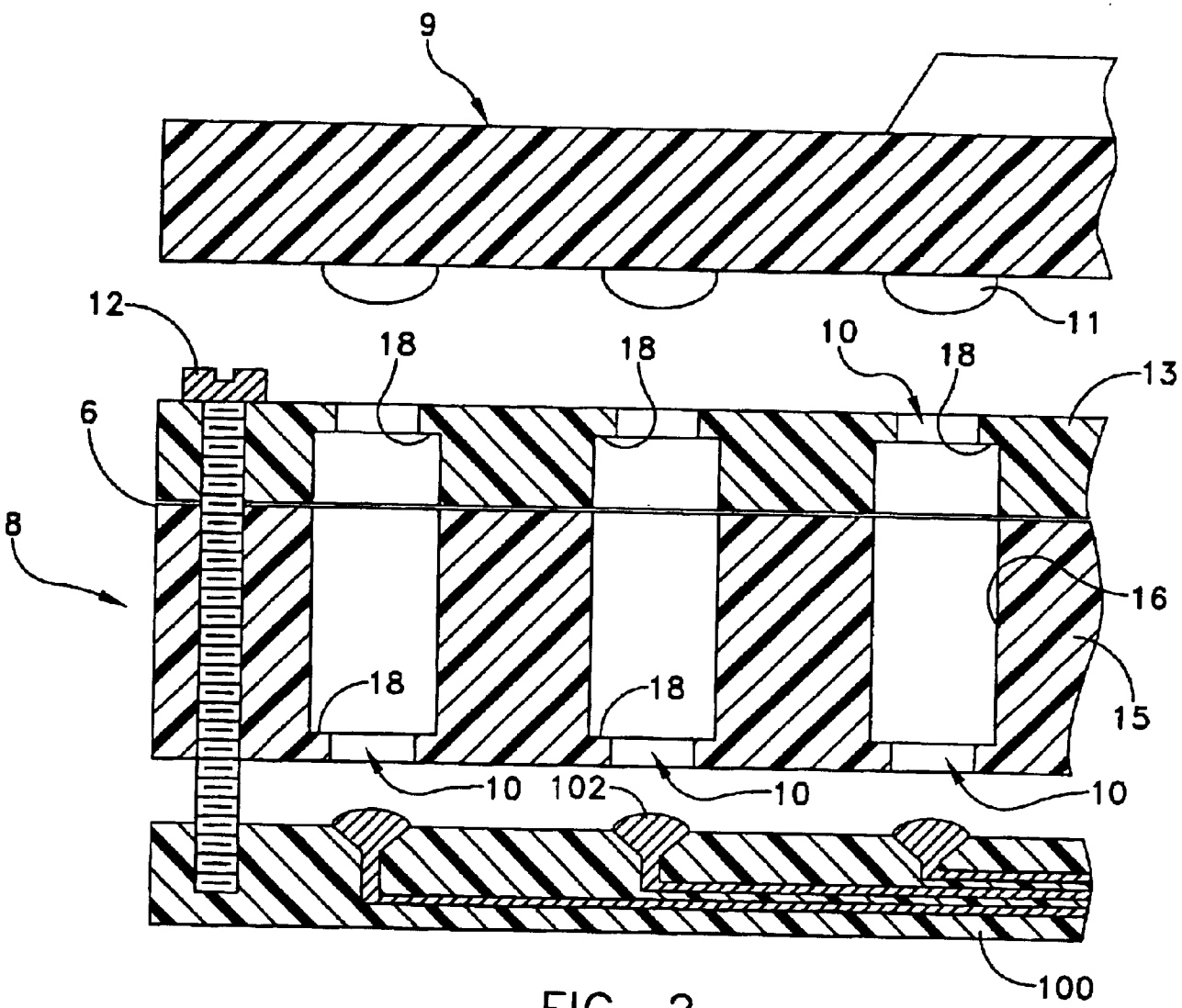
FIG. 2 is a partially broken-away cross-sectional view of an IC package with an interposer housing attached to a printed circuit board, but with the electrical contacts of the present invention removed for clarity of illustration.
Figure 4:
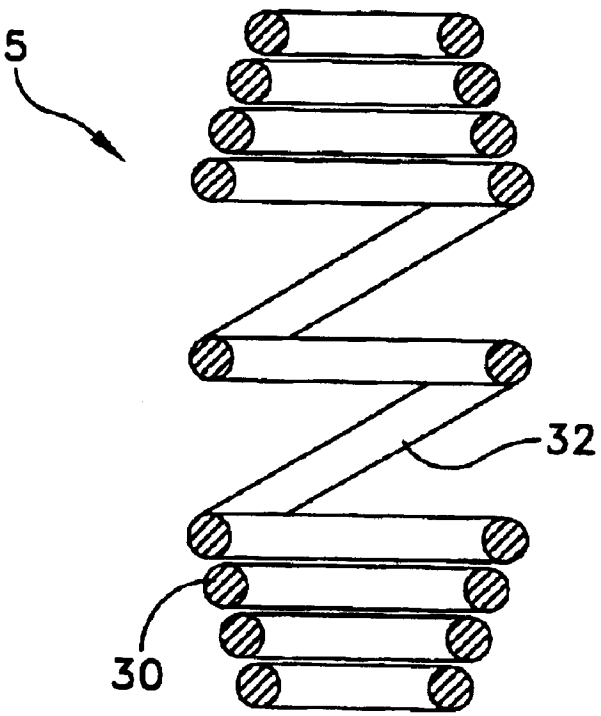
FIG. 4 is a cross-sectional view of the electrical contact shown in FIG. 3, as taken along lines 4—4 in FIG. 3.
Figure 3:
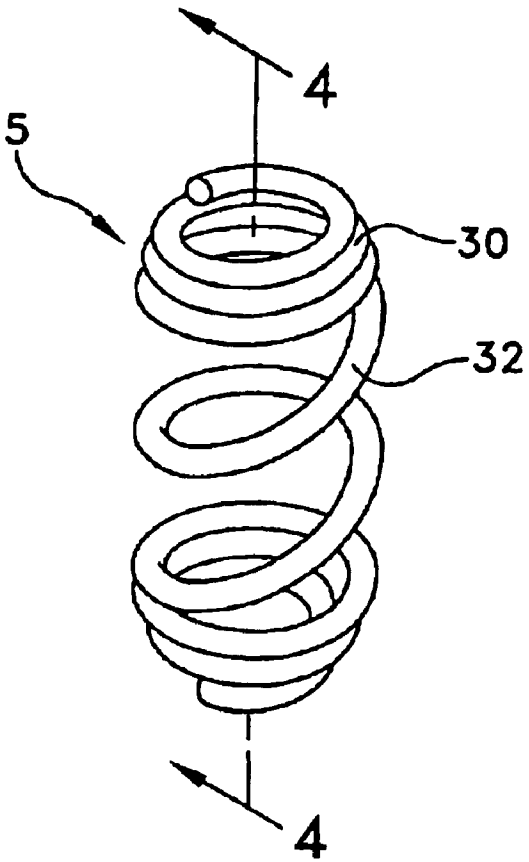
FIG. 3 is a perspective view of an electrical contact formed in accordance with the present invention.

In one embodiment of the invention, ho using 6 is formed from a top half 13 and a mating bottom half 15 such that apertures 10 lead to a receptacle cavity 16, i.e., a void defined within housing 6 by recessed portions of top half 13 and mating bottom half 15 (FIG. 2). Cavity 16 is larger th an apertures 10 such that an annular shoulder 18 surrounds each aperture 10. If interposer 8 is to be mounted to a test circuit board 19 such that electrical contacts 5 are at least partially preloaded, than accommodations are made for releasable fasteners, e.g. screws 12, to be secured through housing 6, and circuit board 100.

Any of the various polymeric materials known to be useful in the electronics industry may be used in connection with housing 6, including, without limitation, thermoplastics (crystalline or non-crystalline, cross-linked or non-crosslinked), thermosetting resins, elastomers or blends or composites thereof. Illustrative examples of useful thermoplastic polymers include, without limitation, polyolefins, such as polyethylene or polypropylene, copolymers (including terpolymers, etc.) of olefins such as ethylene and propylene, with each other and with other monomers such as vinyl esters, acids or esters of -unsaturated organic acids or mixtures thereof, halogenated vinyl or vinylidene polymers such as polyvinyl chloride, polyvinylidene chloride, polyvinyl fluoride, polyvinylidene fluoride and copolymers of these monomers with each other or with other unsaturated monomers, polyesters, such as poly(hexamethylene adipate or sebacate), poly(ethylene terephthalate) and poly (tetramethylene terephthalate), polyamides such as Nylon-6, Nylon-6,6, Nylon-6,10, Versamids, polystyrene, polyacrylonitrile, thermoplastic silicone resins, thermoplastic polyethers, thermoplastic modified cellulose, polysulphones and the like.

Examples of some thermosetting resins useful herein include, without limitation, epoxy resins, such as resins made from epichlorohydrin and bisphenol A or epichlorohydrin and aliphatic polyols, such as glycerol, and which can be conventionally cured using amine or amide curing agents. Other examples include phenolic resins obtained by condensing a phenol with an aldehyde, e.g., phenolformaldehyde resin.

Referring to FIGS. 3–22, high-speed electrical contacts 5 each comprise a compound helical spring formed from a metal having suitable spring properties, e.g., 304V stainless steel wire, beryllium copper wire, or the like, and including one or more transmission-coils 30 and one or more active-coils 32. More particularly, transmission-coils 30 are sections of electrical contact 5 that comprise closely spaced, tightly wound turns, with adjacent coils often circumferentially engaging one another.

Figure 6:
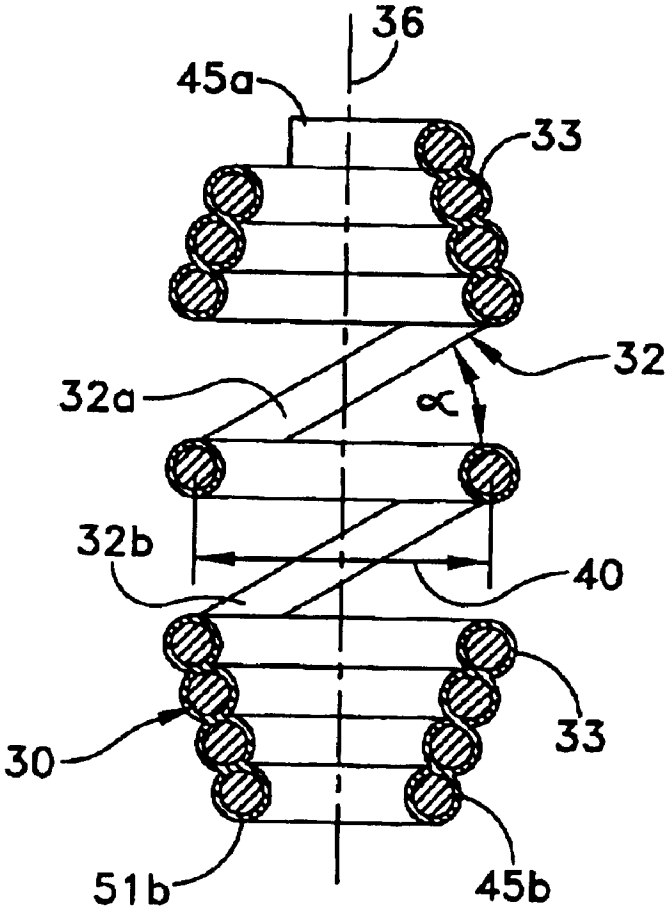
FIG. 6 is a cross-sectional view of the electrical contact shown in FIG. 5, as taken along lines 6—6 in FIG. 5.
Figure 5:
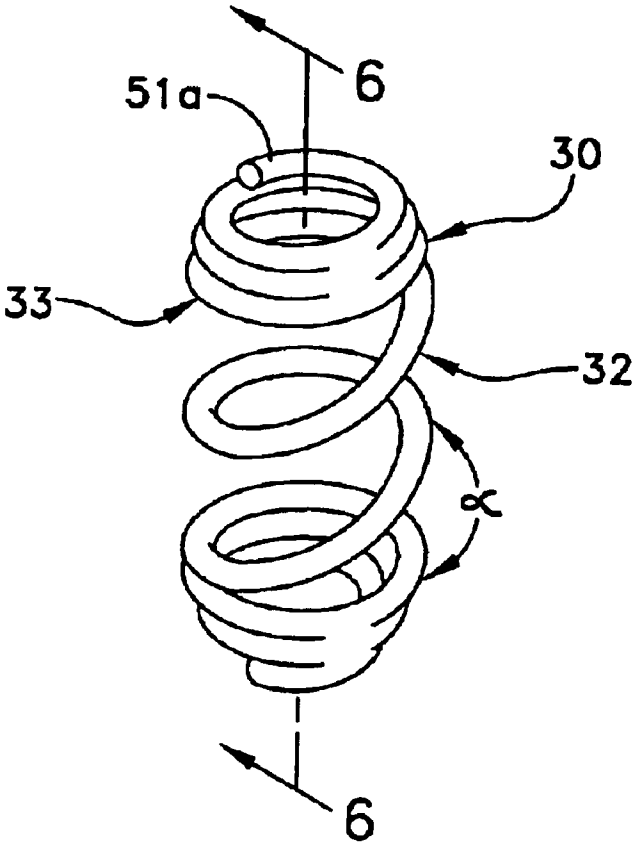
FIG. 5 is a perspective view of an electrical contact similar to FIG. 3, but showing the transmission-coil coated with an electrodeposited conductive noble metal.

Transmission-coils 30 are preferably coated with an electrodeposited layer of a highly electrically conductive metal 33, such as copper, silver, gold, palladium, or the like so as to fuse each of the tightly wound turns together (FIGS. 5, 6, 9, 10, 13, 14, 17, 18, and 21, 22). In this way, transmission-coils 30 form the skeleton of a substantially solid, highly conductive tubular section of electrical contacts 5, having a layer of electrically conductive metal with a thickness that will ensure a desired level of high electrical conductance through transmission-coils 30. In other words, the application of metal layer 33 to transmission-coils 30 provides an effective electrical length of transmission-coils 30 that is not the total length of the wire forming the coils, but instead is essentially their longitudinal length, i.e., the length of a group of transmission-coils as measured parallel to the longitudinal axis 36 of electrical contact 5 (FIG. 6). In effect, high speed electrical signals passing through electrical contacts 5 are conducted essentially within over coated layer 33.

Active-coils 32 are typically integral with transmission-coils 30 so as to communicate between two adjacent transmission-coil sections, and comprise a mean coil diameter 40 and coil-to-coil pitch $\alpha$, so as to provide a preselected spring rate when compressed together. Active-coils 32 and transmission-coils 30 may be either left-hand wound or right-hand wound from a single wire. Also, electrical contacts 5 may include only one active-coil 32, or a plurality of active-coils 32, as required for a particular interconnection application. For example, in one embodiment, two transmission-coil sections 45*a* and 45*b* are spaced apart by two active-coils 32*a*,32*b*. Each transmission-coil section 45*a*,45*b* often includes four transmission-coil turns that are formed so as to have a pitch angle $\alpha$ that is less than about 10°, and a successively varying mean diameter so as to form a tapered profile (FIG. 6). The tapered profile provides for more accurate true position location of each electrical contact with respect to contact pads 11 on IC package 9. Transmission-coil sections 45*a*,45*b* are over coated with a conductive layer of copper 33 (e.g., via electroplating, sputtering, or hot dipping) so as to minimize the effective electrical path length, with at least the terminal coil surfaces 51*a*,51*b* further coated with a highly conductive noble metal, such as gold or the like. Active-coils 32*a*,32*b* are positioned between transmission-coil sections 45*a*,45*b* and comprise mean coil diameter 40 and a pitch angle a selected to provide the requisite contact normal force. It will be understood that one or more of the active-coils may be over coated with a conductive layer of copper 33, and further coated (e.g., via electroplating, sputtering, or hot dipping) with both a barrier metal layer and a highly conductive noble metal, such as gold or the like.

Figure 8:
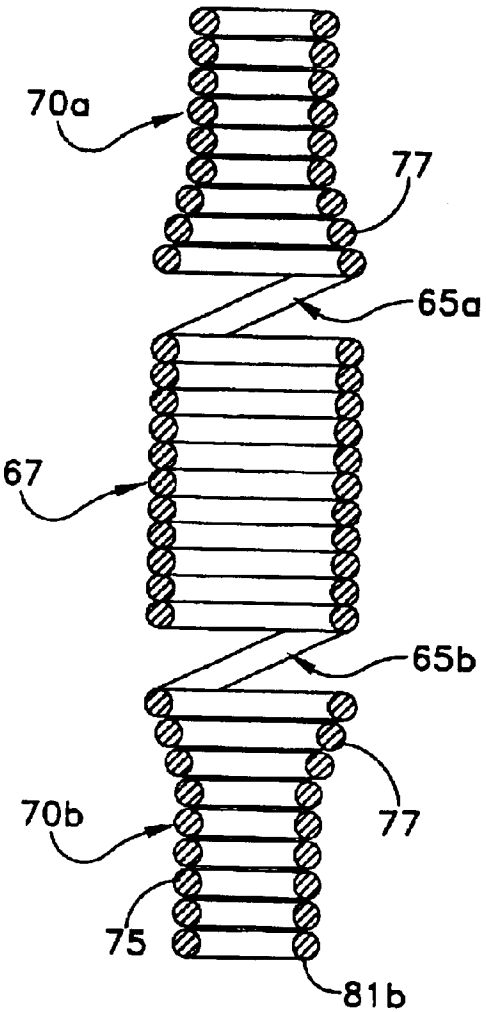
FIG. 8 is a cross-sectional view of the electrical contact shown in FIG. 7, as taken along line 8—8 in FIG. 7.
Figure 7:
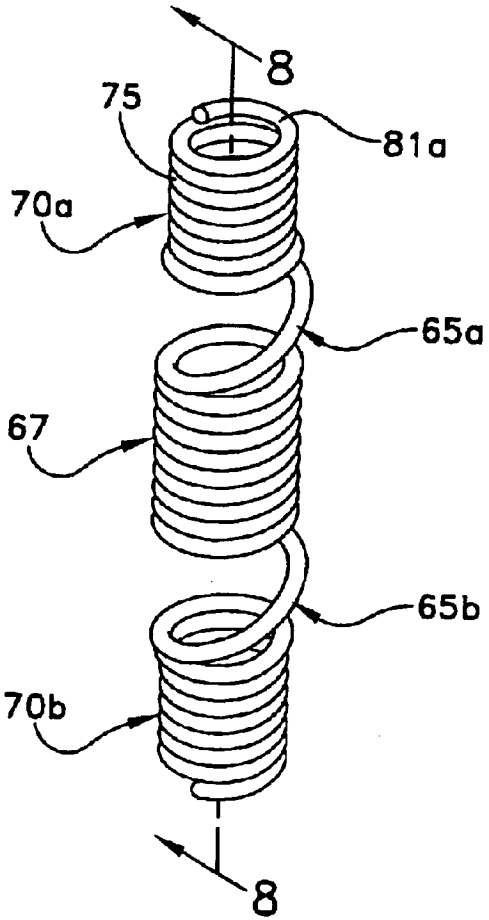
FIG. 7 is a perspective view of an alternative embodiment of electrical contact formed in accordance with the present invention.
Figure 10:
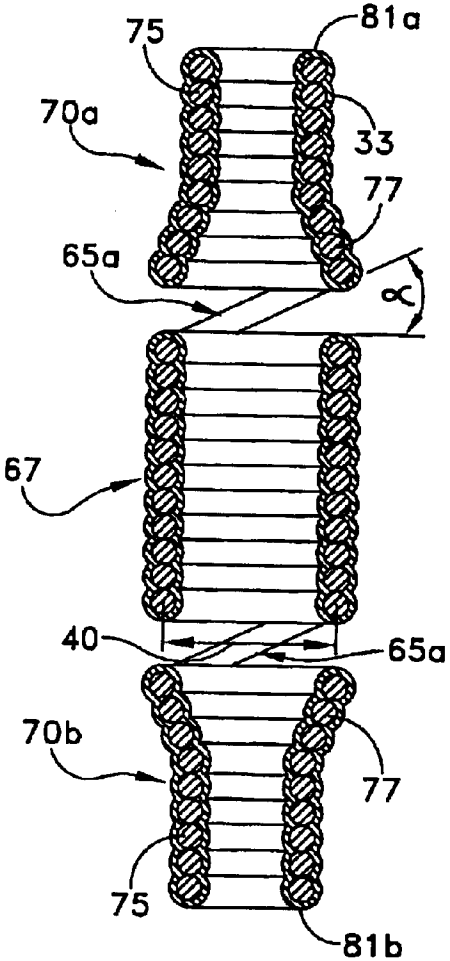
FIG. 10 is a cross-sectional view of the electrical contact shown in FIG. 9, as taken along line 10—10 in FIG. 9.
Figure 9:
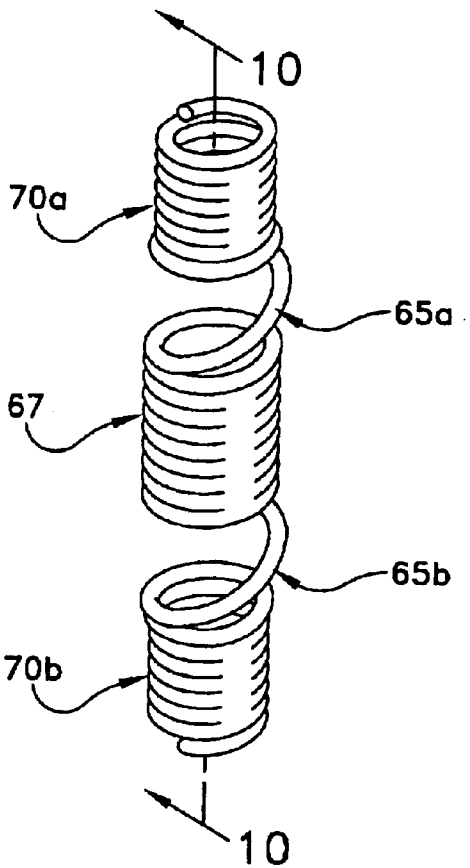
FIG. 9 is a perspective view of electrical contact shown in FIG. 7, with the transmission-coil coated with an electrodeposited conductive noble metal.

In another embodiment, two active-coil sections 65*a* and 65*b* are spaced apart by one transmission-coil 67 with each having an end transmission-coil 70*a*,70*b* (FIG. 8). Each active-coil section 65*a*,65*b* comprises a mean coil diameter 40 and a pitch angle $\alpha$ selected to provide the requisite contact normal force. Normal forces in the range from about twenty grams to about forty grams can be achieved through the proper adjustment of wire diameter, coil diameter, and pitch angle. Transmission-coil section 67 is over coated with a conductive, relatively thick layer of copper 33 so as to minimize the effective electrical path length, and comprises six or seven generally cylindrically shaped sections of turns. Each end transmission-coil 70*a*,70*b* comprises a six or seven turn, constant mean coil diameter section 75 and one or more coils of varying mean coil diameter so as to form a tapered transition section 77. At least the terminal coil surfaces 81*a*,81*b* are coated with a highly conductive noble metal, such as gold or the like.

Figure 6B:
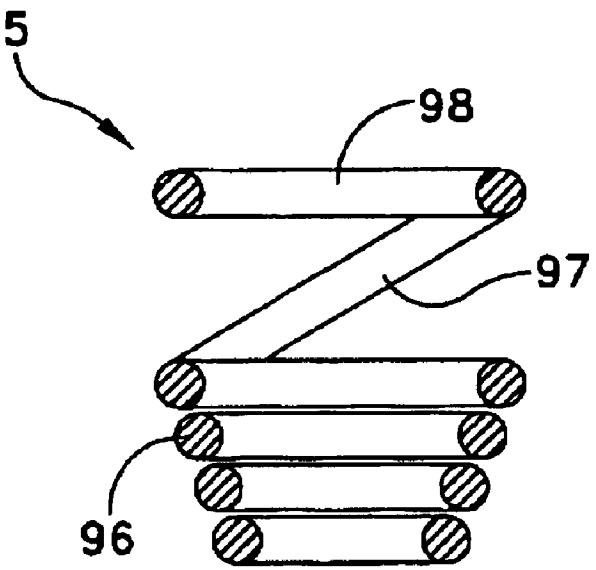
FIG. 6*b* is a cross-sectional view of the electrical contact shown in FIG. 6*a*, as taken along lines 6*b*—6*b* in FIG. 6*a;*
Figure 6A:
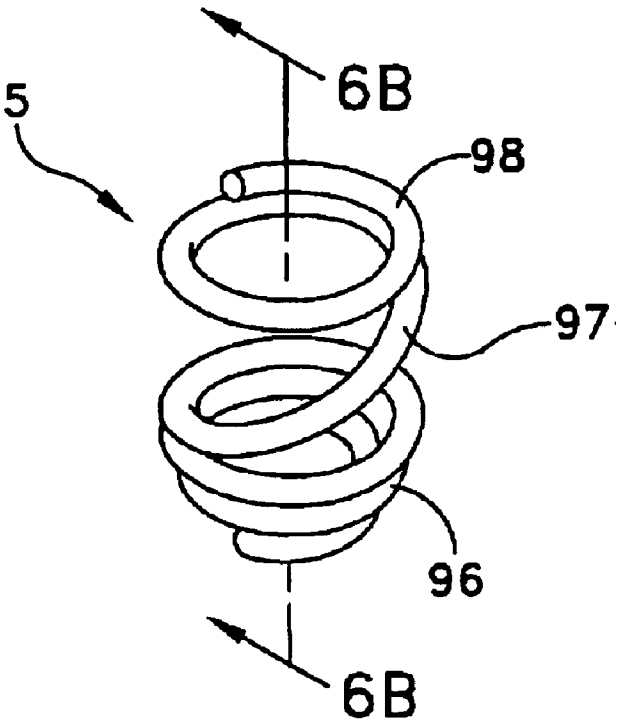
FIG. 6*a* is a perspective view of an electrical contact similar to that shown in FIGS. 3–6, but showing a single transmission-coil, single active-coil, and single turn interface according to an alternative embodiment of the invention.
Figure 6C:
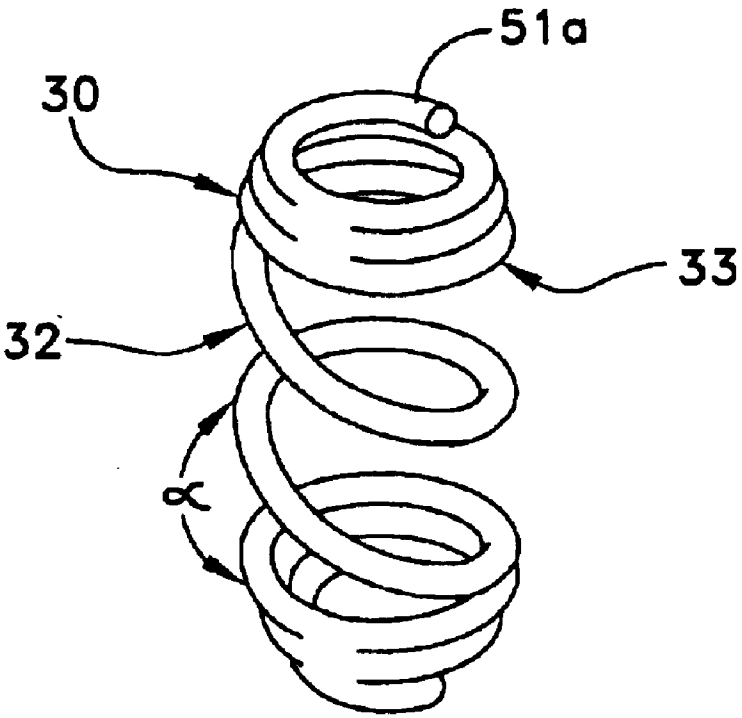
FIG. 6*c* is a perspective view of an electrical contact similar to that shown in FIGS. 3–6, but showing a single transmission-coil, a multiple active-coil, and multiple turn interface according to an alternative embodiment of the invention.
Figure 12:
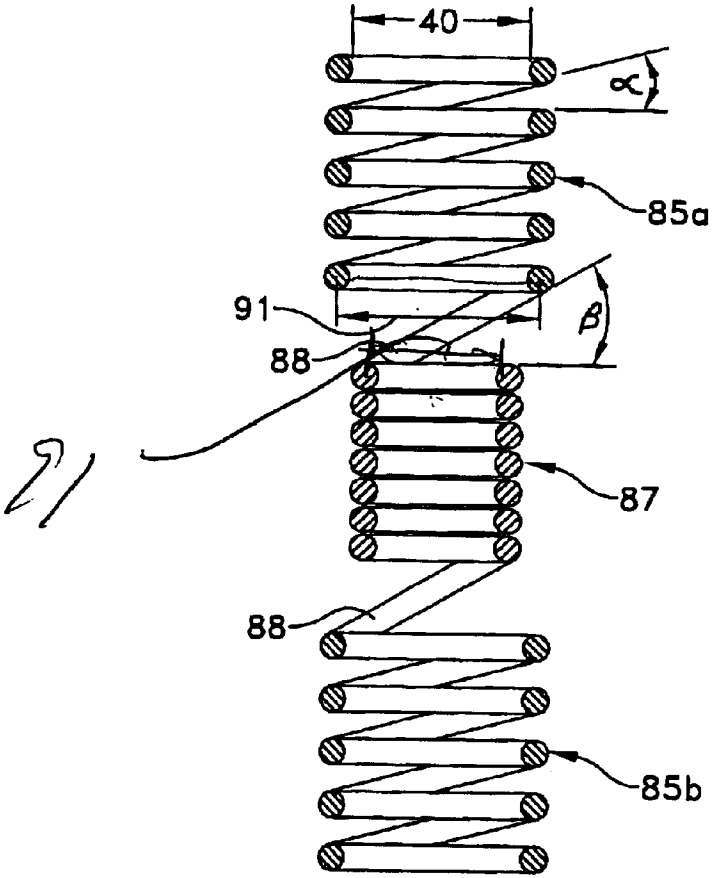
FIG. 12 is a cross-sectional view of the electrical contact shown in FIG. 11, as taken along line 12—12 in FIG. 11.
Figure 11:
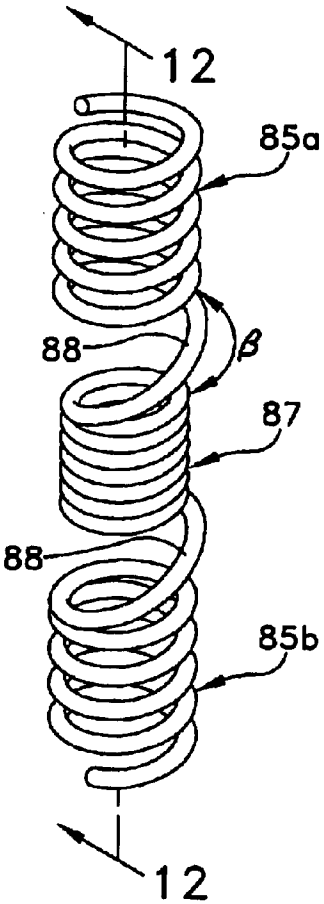
FIG. 11 is a further alternative embodiment of electrical contact formed in accordance with the present invention.
Figure 14:
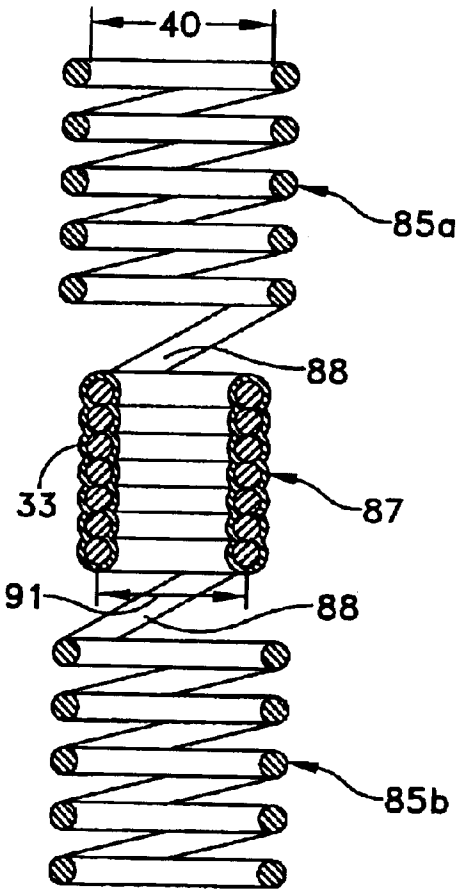
FIG. 14 is a cross-sectional view of the electrical contact shown in FIG. 13, as taken along line 14—14 in FIG. 13.
Figure 13:
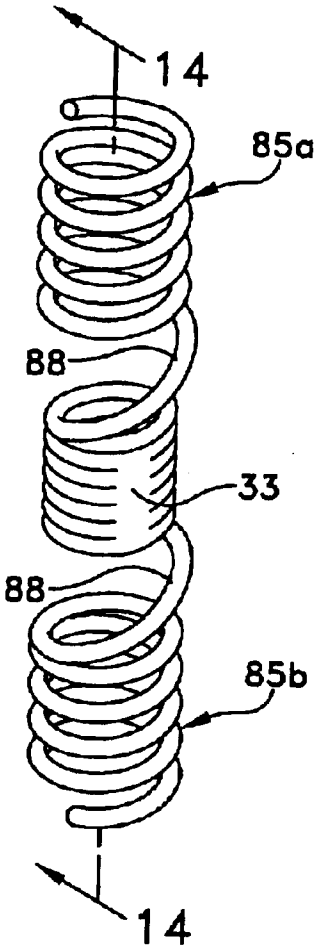
FIG. 13 is a perspective view of the electrical contact shown in FIG. 11, with the transmission-coil coated with an electrodeposited conductive noble metal.
Figure 16:
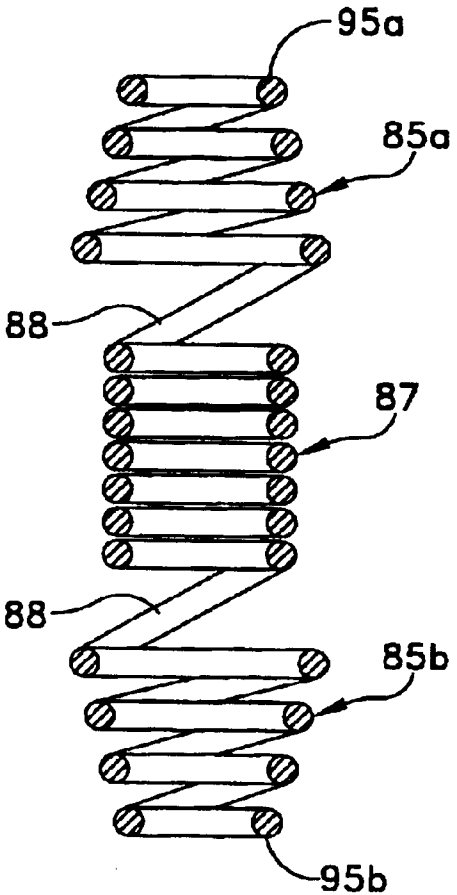
FIG. 16 is a cross-sectional view of the electrical contact shown in FIG. 15, as taken along line 16—16 in FIG. 15.
Figure 15:
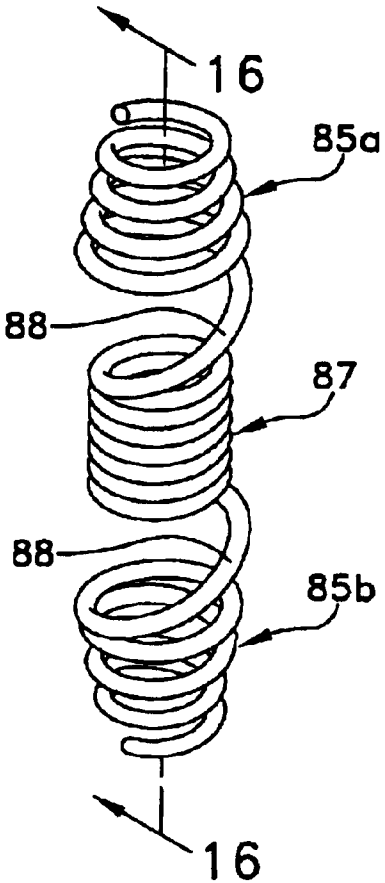
FIG. 15 is a perspective view of a further alternative embodiment of electrical contact formed in accordance with the present invention.
Figure 18:
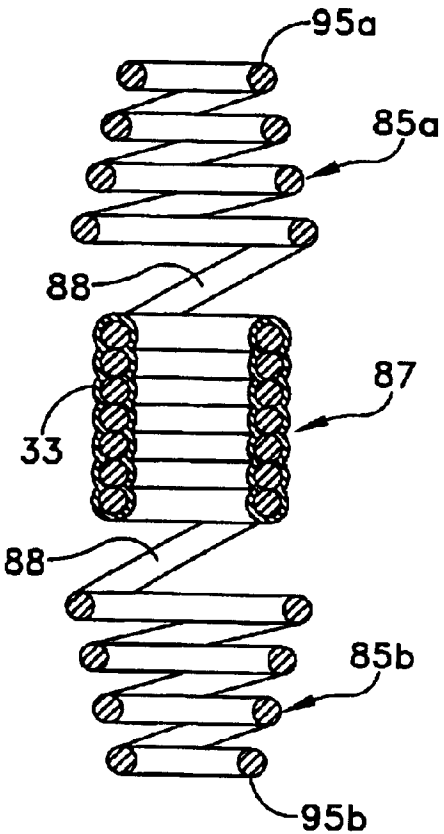
FIG. 18 is a cross-sectional view of the electrical contact shown in FIG. 17, as taken along line 18—18 in FIG. 17.
Figure 17:
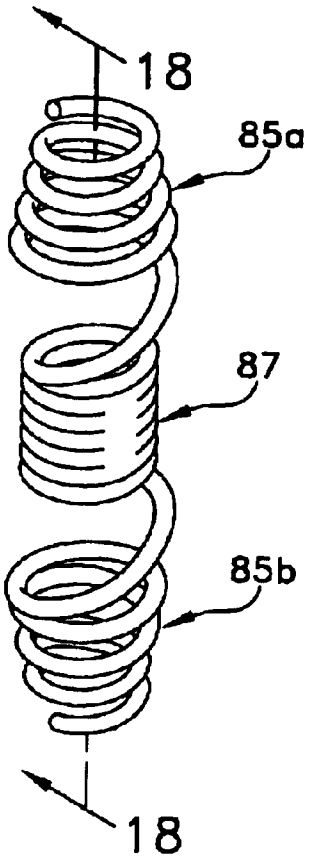
FIG. 17 is a perspective view of the electrical contact shown in FIG. 15, with the transmission-coil coated with an electrodeposited conductive noble metal.
Figure 20:
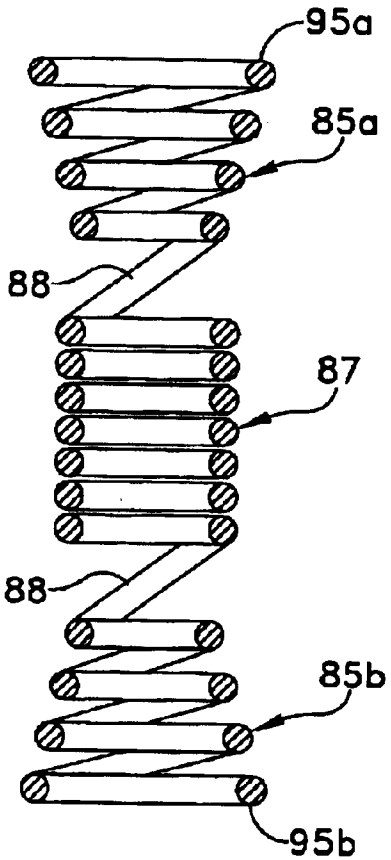
FIG. 20 is a cross-sectional view of the electrical contact shown in FIG. 19, as taken along line 20—20 in FIG. 19.
Figure 19:
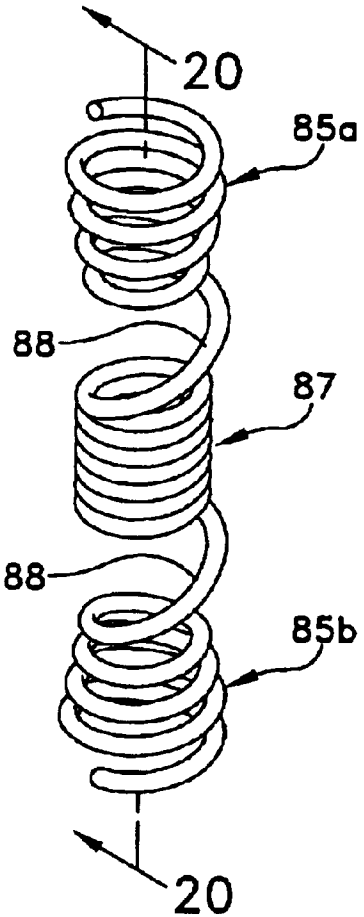
FIG. 19 is a perspective view of yet another alternative embodiment of electrical contact formed in accordance with the present invention.
Figure 22:
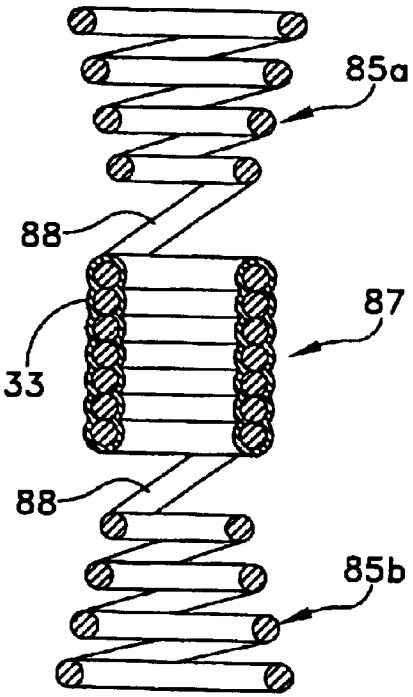
FIG. 22 is a cross-sectional view of the electrical contact shown in FIG. 21, as taken along line 22—22 in FIG. 21.
Figure 21:
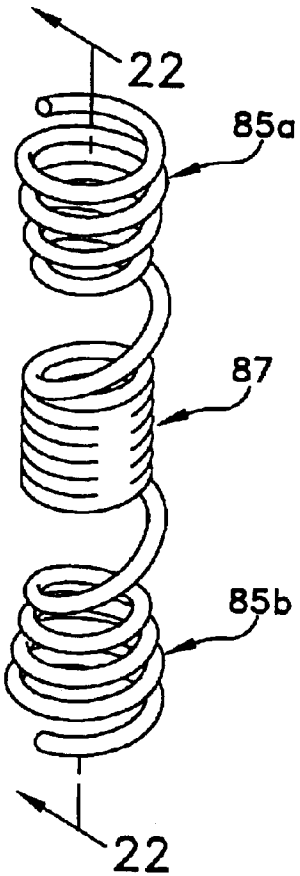
FIG. 21 is a perspective view of the electrical contact shown in FIG. 19, with the transmission-coil coated with an electrodeposited conductive noble metal.

Of course, it is not necessary to arrange the closely spaced transmission-coils at the ends of electrical contacts 5. Although less preferred, it is also possible to reverse the arrangement of coil sections in the present invention (FIG. 12). For example, two active-coil sections 85*a* and 85*b* may be spaced apart by one transmission-coil 87. Each active-coil section 85*a*,85*b* comprises a mean coil diameter 40 and a pitch angle a selected to provide the requisite contact normal force. A transition-coil 88 is also provided to allow for the connection of each active-coil section 85*a*,85*b* to the centrally located transmission-coil 87. Transition-coils 88 have a mean coil diameter 91 and a pitch angle β that may differ from the coil diameter and pitch angle of active-coil sections 85*a*,85*b*. This construction allows for a very wide range of spring properties and loading schemes to be employed in the present invention. In an alternative embodiment, one or both of active-coil sections 85*a*,85*b* have a successively varying mean coil diameter so as to form an outwardly (FIGS. 15–18 ) or inwardly (FIGS. 19–22) tapered profile. At least the terminal coil surfaces 95*a*,95*b* are coated with a highly conductive noble metal, such as gold or the like. Transmission-coil section 87 is again over coated with a conductive layer of copper 33 so as to minimize the effective electrical path length. Of course, an alternative embodiment of the invention may comprise a single transmission-coil 96, single active-coil 97, and single turn interface coil 98 (FIGS. 6*a* and 6*b*).

Figure 23:
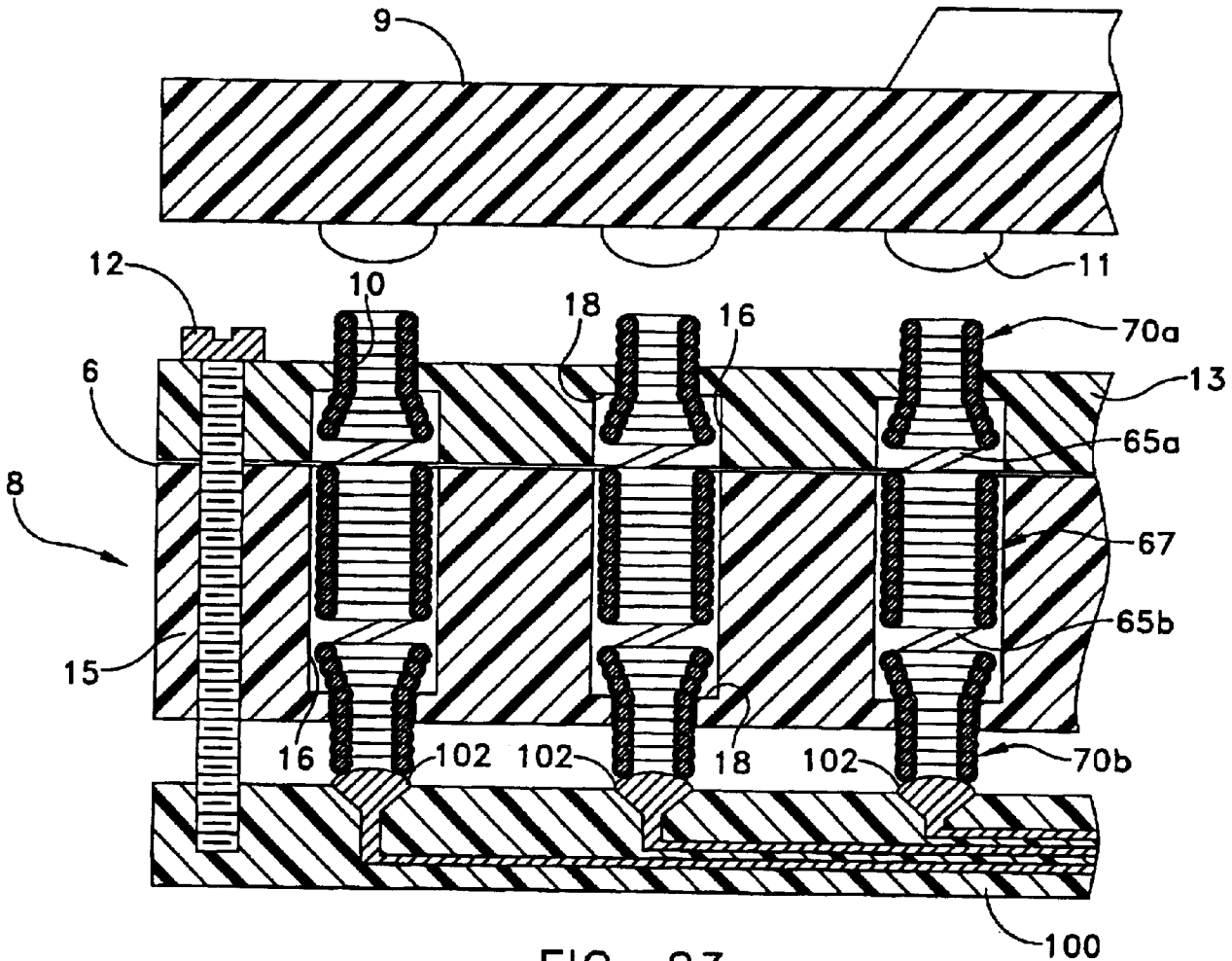
FIG. 23 is a partially broken-away cross-sectional view of an IC package positioned above an LGA interposer arranged in accordance with the present invention.
Figure 24:
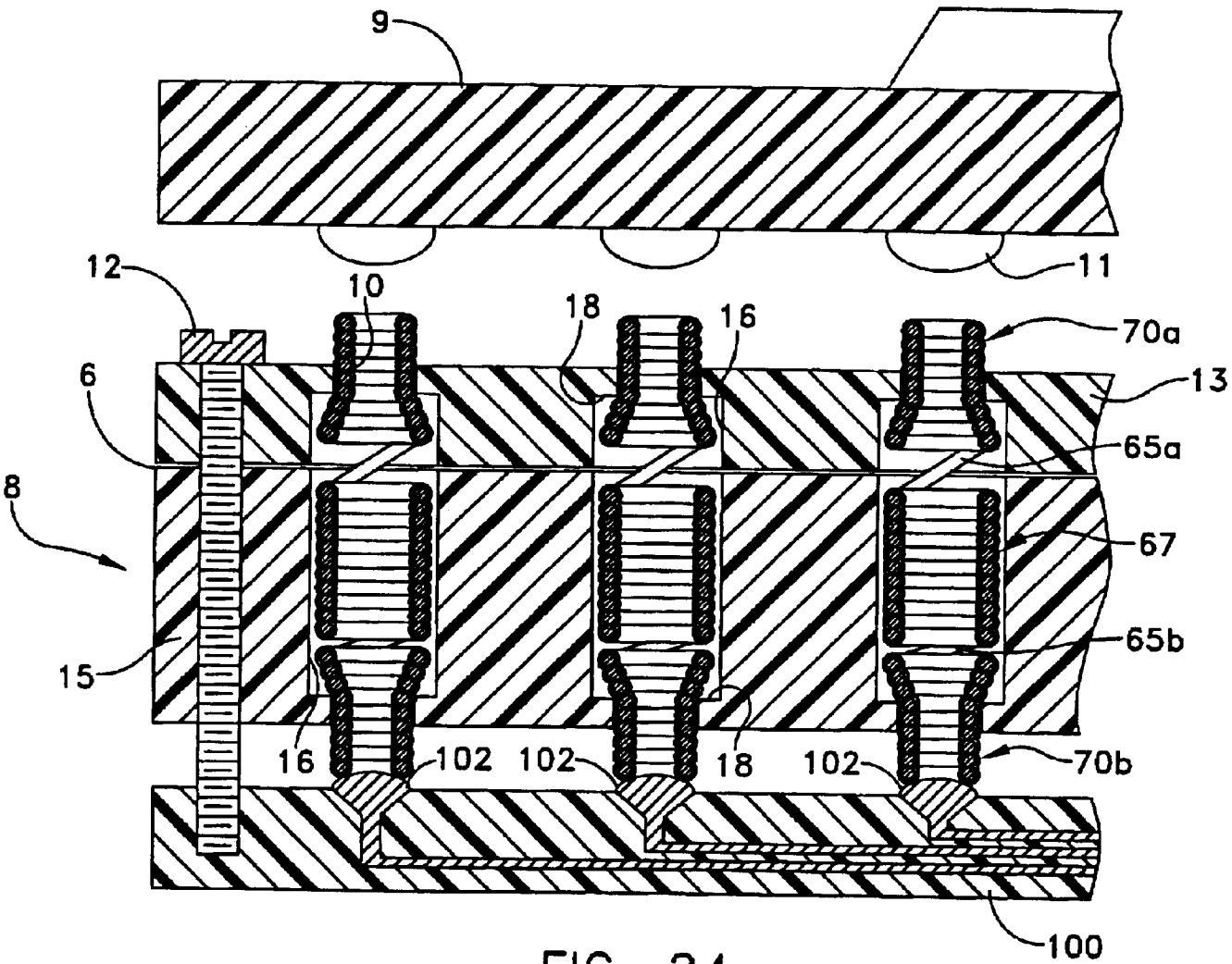
FIG. 24 is similar to FIG. 23, but with a PC board-side set of transmission-coils pre-loaded in anticipation of the mounting of an IC package.
Figure 25:
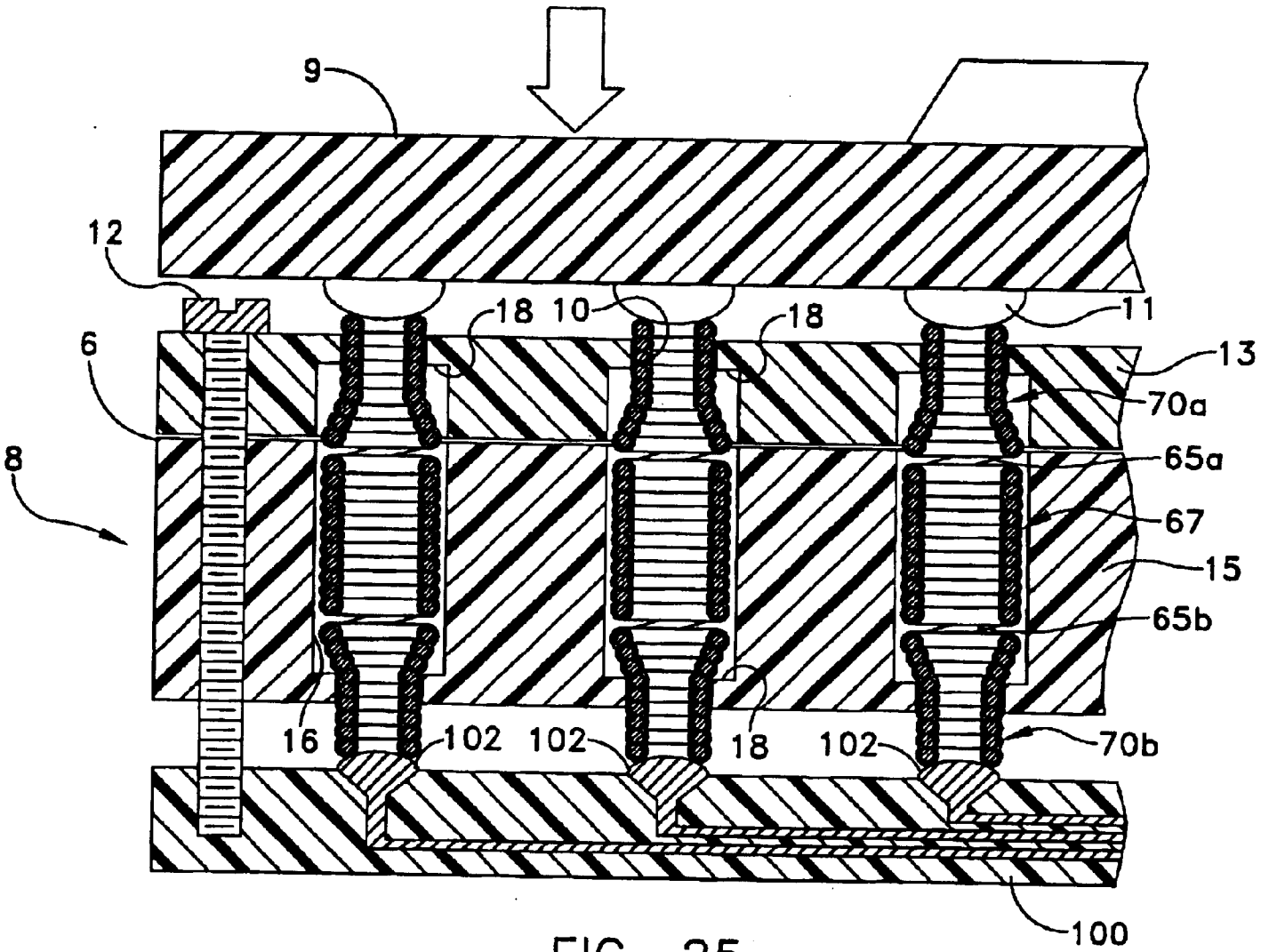
FIG. 25 is a partially broken-away cross-sectional view of an IC package mounted to an LGA interposer formed in accordance with the present invention, in full electrical and data transmission contact with the electrical contacts of the present invention.

The electrical contacts of the present invention are arranged within housing 6 to form LGA interposer 8. Although the following description of one preferred embodiment of LGA interposer 8 will be disclosed in connection with one embodiment of electrical contact, it will be understood that all variations and their obvious equivalents may be used to form an LGA interposer in accordance with the present invention. Referring to FIGS. 2 and 23–25, with top half 13 removed from housing 6, each electrical contact 5 is oriented so as to be in substantially coaxial confronting relation with the entrance to receptacle cavity 16. Once in this position, each electrical contact 5 is moved toward mating bottom half 15 until the inner surfaces of annular shoulder 18 of bottom half 15 engage a portion of each electrical contact 5. In many of the embodiments of electrical contact 5, angular shoulder 18 will engage one or more transition coils (e.g., transition coils 77 in FIGS. 7–10) so that electrical contact 5 is retained within receptacle cavity 16. Once in this position, top half 13 is arranged over top of bottom half 15 with a portion of each electrical contact 15 positioned within each aperture 10. Here again, a portion of electrical contact 5 engages annular shoulder 18 so as to be retained within LGA interposer 8. (FIG. 23).

In many applications where an IC package 9 is to be temporarily mounted to a test circuit board 100, it is advantageous to pre-load each of the electrical contacts against circuit traces 102 on test circuit board 100 so that reliable electrical and mechanical engagement may be maintained between LGA interposer 8 and test circuit board 100. With the present invention, screws 12 may be mounted in corresponding threaded holes within test circuit board 100 such that, as screws 12 are threaded into their corresponding holes within housing 6 and test circuit board 100, they draw housing 6 toward test circuit board 100. As this happens, annular shoulders 18 engage transition portions 77 and thereby compress active-coils 65*b* in each of electrical contacts 5. As this occurs, terminal-coil surfaces 81*b* are pressed into intimate electrical and mechanical contact with corresponding circuit traces 102 on the surface of test circuit board 100. The magnitude of the pre-loaded contact force applied to circuit traces 102 may be pre-determined by appropriate selection of a spring constant for active-coil sections 65*b* in each of electrical contacts 5. It should be noted that the spring rate for individual electrical contacts 5 may be varied within LGA interposer 8 so that variations in pre-loaded contact force may be provided to accommodate surface features or physical requirements of the surface of test circuit board 100.

Once LGA interposer 8 has been pre-loaded (FIG. 24), an IC package 9 may be positioned above transmission-coils 70*a* of electrical contacts 5 and pressed downwardly so as to compress active-coil sections 65*a* in each of electrical contacts 5, thereby creating an electrical circuit between test circuit board 100 and contact pads 11 of IC package 9. Advantageously, each of the transmission-coil sections have been over coated with an electrodeposited layer of copper or similar highly conductive noble metal. Thus, as electrical signals pass between test circuit board 100 and IC package 9, the electrical path length is minimized through electrical contacts 5. In particular, the over coated portions of electrical contact 5 act as a substantially solid, highly conductive transmission path so as to maintain a pre-selected characteristic impedance for the electrical system.

It is to be understood that the present invention is by no means limited only to the particular constructions herein disclosed and shown in the drawings, but also comprises any modifications or equivalents within the scope of the claims.

What is claimed is:

1. An electrical contact comprising at least two active-coil sections that electrically communicate with one another through a centrally located transmission-coil section comprising at least two tightly wound turns wherein said one transmission-coil section is over coated with a conductive noble metal so as to fuse said at least two tightly wound turns together wherein said transition-coil has a mean coil diameter and a pitch angle that differs from a coil diameter and a pitch angle of said active-coil sections.

2. An electrical contact according to claim 1 wherein said two active-coil sections are spaced apart by said one transmission-coil.

3. An electrical contact according to claim 1 wherein each active-coil section comprises a mean coil diameter and a pitch angle selected to provide a requisite contact normal force.

4. An electrical contact according to claim 1 wherein at least one of said active-coil sections has a successively varying mean coil diameter so as to form an outwardly tapered profile.

5. An electrical contact according to claim 1 wherein at least one of said active-coil sections has a successively varying mean coil diameter so as to form an inwardly tapered profile.

6. An electrical contact comprising three transmission-coil sections each having a longitudinal length, and comprising at least two tightly wound turns, and two active-coil sections wherein one of said two active-coil sections is positioned between two of said three transmission-coil sections, and each resiliently communicating between said three transmission-coil sections, wherein said three transmission-coil sections are over coated with a layer of conductive metal so as to fuse each of said at least two tightly wound turns together, thereby providing an effective electrical length for each transmission-coil that is substantially equal to their longitudinal length.

7. An electrical contact according to claim 6 wherein said three transmission-coil sections and said two active-coil sections each comprise a compound helical spring.

8. An electrical contact according to claim 6 wherein said three transmission-coil sections and said two active-coil sections each comprise at least one of stainless steel wire and beryllium copper wire.

9. An electrical contact according to claim 6 wherein said three transmission-coil sections and said two active-coil sections are circumferentially engaging one another.

10. An electrical contact according to claim 6 wherein said three transmission-coil sections are over coated with an electrodeposited layer of at least one of copper, silver, gold, and palladium so as to fuse each of said tightly wound turns together.

11. An electrical contact according to claim 6 wherein said two active-cod sections are integral with said three transmission-coil sections.

12. An electrical contact according to claim 6 comprising only one active-col.

13. An electrical contact according to claim 6 wherein each of said three transmission-coil sections includes at least four transmission-coil turns.

14. An electrical contact according to claim 6 wherein said three transmission-coil sections include at least two turns that have a successively varying mean diameter so as to form a tapered profile.

15. An electrical contact according to claim 6 wherein said two active-coil sections are spaced apart by one transmission-coil section.

16. An electrical contact according to claim 15 wherein said one transmission-coil section is over coated with a conductive layer of copper so as to minimize the effective electrical path length.

17. An electrical contact according to claim 6 wherein said three transmission-coil sections comprise at least one of six and seven cylindrically shaped turns.

18. An electrical contact according to claim 6 wherein transmission-coils are disposed at ends of said electrical contact and comprise at least one of six and seven turns and at least two coils of varying mean coil diameter so as to form a tapered transition section.

* * * * *

UNITED STATES PATENT AND TRADEMARK OFFICE

CERTIFICATE OF CORRECTION

PATENT NO. : 6,846,184 B2
DATED : January 25, 2005
INVENTOR(S) : Zhineng Fan et al.

It is certified that error appears in the above-identified patent and that said Letters Patent is hereby corrected as shown below:

Column 9,
Lines 22 and 25, change “cod” to -- coil --

Signed and Sealed this

Tenth Day of May, 2005

JON W. DUDAS
*Director of the United States Patent and Trademark Office*